US007276656B2

(12) United States Patent
Wang

(10) Patent No.: US 7,276,656 B2
(45) Date of Patent: Oct. 2, 2007

(54) METHOD FOR MUSIC ANALYSIS

(75) Inventor: Chun-Yi Wang, Taipei (TW)

(73) Assignee: Ulead Systems, Inc., Taipei (TW)

( * ) Notice: Subject to any disclaimer, the term of this patent is extended or adjusted under 35 U.S.C. 154(b) by 591 days.

(21) Appl. No.: 10/823,536

(22) Filed: Apr. 14, 2004

(65) Prior Publication Data

US 2005/0217461 A1 Oct. 6, 2005

(30) Foreign Application Priority Data

Mar. 31, 2004 (JP) ..... 2004-103172

(51) Int. Cl.
*G10H 7/00* (2006.01)

(52) U.S. Cl. ..... 84/612

(58) Field of Classification Search ..... 84/612, 84/636, 652, 623

See application file for complete search history.

(56) References Cited

U.S. PATENT DOCUMENTS 5,614,687 A * 3/1997 Yamada et al. ..... 84/662
6,316,712 B1 * 11/2001 Laroche ..... 84/636
7,050,980 B2 * 5/2006 Wang et al. ..... 704/503
2003/0045953 A1 * 3/2003 Weare ..... 700/94
2003/0221544 A1 * 12/2003 Weissflog ..... 84/667
2005/0217462 A1 * 10/2005 Thomson et al. ..... 84/612
2006/0048634 A1 * 3/2006 Lu et al. ..... 84/612

* cited by examiner

*Primary Examiner*—Jeffrey W Donels
(74) *Attorney, Agent, or Firm*—Birch, Stewart, Kolasch & Birch, LLP

(57) ABSTRACT

A method for music analysis. The method includes the steps of acquiring a music soundtrack, re-sampling an audio stream of the music soundtrack so that the re-sampled audio stream is composed of blocks, applying FFT to each block, deriving a vector from each transformed block, wherein the vector components are energy summations of the block within different sub-bands, applying auto-correlation to each sequence composed of the vector components of all the blocks in the same sub-band using different tempo values, wherein, for each sequence, a largest correlation result is identified as a confidence value and the tempo value generating the largest correlation result is identified as an estimated tempo, and comparing the confidence values of all the sequences to identify the estimated tempo having the largest confidence value as a final estimated tempo.

16 Claims, 2 Drawing Sheets

METHOD FOR MUSIC ANALYSIS

This Nonprovisional application claims priority under 35 U.S.C. 119(a) on Patent Application No(s). 2004-103172 filed in Japan on Mar. 31, 2004, the entire contents of which are hereby incorporated by reference.

BACKGROUND OF THE INVENTION

1. Field of the Invention

The present invention relates to music analysis and particularly to a method for tempo estimation, beat detection and micro-change detection for music, which yields indices for alignment of soundtracks with video clips in an automated video editing system.

2. Description of the Related Art

Automatic extraction of rhythmic pulse from musical excerpts has been a topic of active research in recent years. Also called beat-tracking and foot-tapping, the goal is to construct a computational algorithm capable of extracting a symbolic representation which corresponds to the phenomenal experience of "beat" or "pulse" in a human listener.

The experience of rhythm involves movement, regularity, grouping, and yet accentuation and differentiation. There is no "ground truth" for rhythm to be found in simple measurements of an acoustic signal.

As contrasted with "rhythm" in general, "beat" and "pulse" correspond only to "the sense of equally spaced temporal units."

It is important to note that there is no simple relationship between polyphonic complexity—the number and timbres of notes played at a single time—in a piece of music, and its rhythmic complexity or pulse complexity. There are pieces and styles of music which are texturally and timbrally complex, but have straightforward, perceptually simple rhythms; and there also exist musics which deal in less complex textures but are more difficult to rhythmically understand and describe.

The former sorts of musical pieces, as contrasted with the latter sorts, have a "strong beat". For these kinds of music, the rhythmic response of listeners is simple, immediate, and unambiguous, and every listener will agree on the rhythmic content.

In Automated Video Editing (AVE) systems, music analysis process is essential to acquire indices for alignment of soundtracks with video clips. In most pop music videos, video/image shot transitions usually occur at the beats. Moreover, fast music is usually aligned with many short video clips and fast transitions, while slow music is usually aligned with long video clips and slow transitions. Therefore, tempo estimation and beat detection are two major and essential processes in an AVE system. In addition to beat and tempo, another important information essential to the AVE system is micro-changes, which is locally significant changes in a music, especially for music without drums or difficult to accurately detect beats and estimate tempo.

SUMMARY OF THE INVENTION

The object of the present invention is to provide a method for tempo estimation, beat detection and micro-change detection for music, which yields indices for alignment of soundtracks with video clips.

The present invention provides a method for music analysis comprising the steps of acquiring a music soundtrack, re-sampling an audio stream of the music soundtrack so that the re-sampled audio stream is composed of blocks, applying Fourier Transformation to each of the blocks, deriving a first vector from each of the transformed blocks, wherein components of the first vector are energy summations of the block within a plurality of first sub-bands, applying auto-correlation to each sequence composed of the components of the first vectors of all the blocks in the same first sub-band using a plurality of tempo values, wherein, for each sequence, a largest correlation result is identified as a confidence value and the tempo value generating the largest correlation result is identified as an estimated tempo, and comparing the confidence values of all the sequences to identify the estimated tempo corresponding to the largest confidence value as a final estimated tempo.

BRIEF DESCRIPTION OF THE DRAWINGS

The present invention will become more fully understood from the detailed description given hereinbelow and the accompanying drawings, given by way of illustration only and thus not intended to be limitative of the present invention.

DETAILED DESCRIPTION OF THE INVENTION

Figure 1:
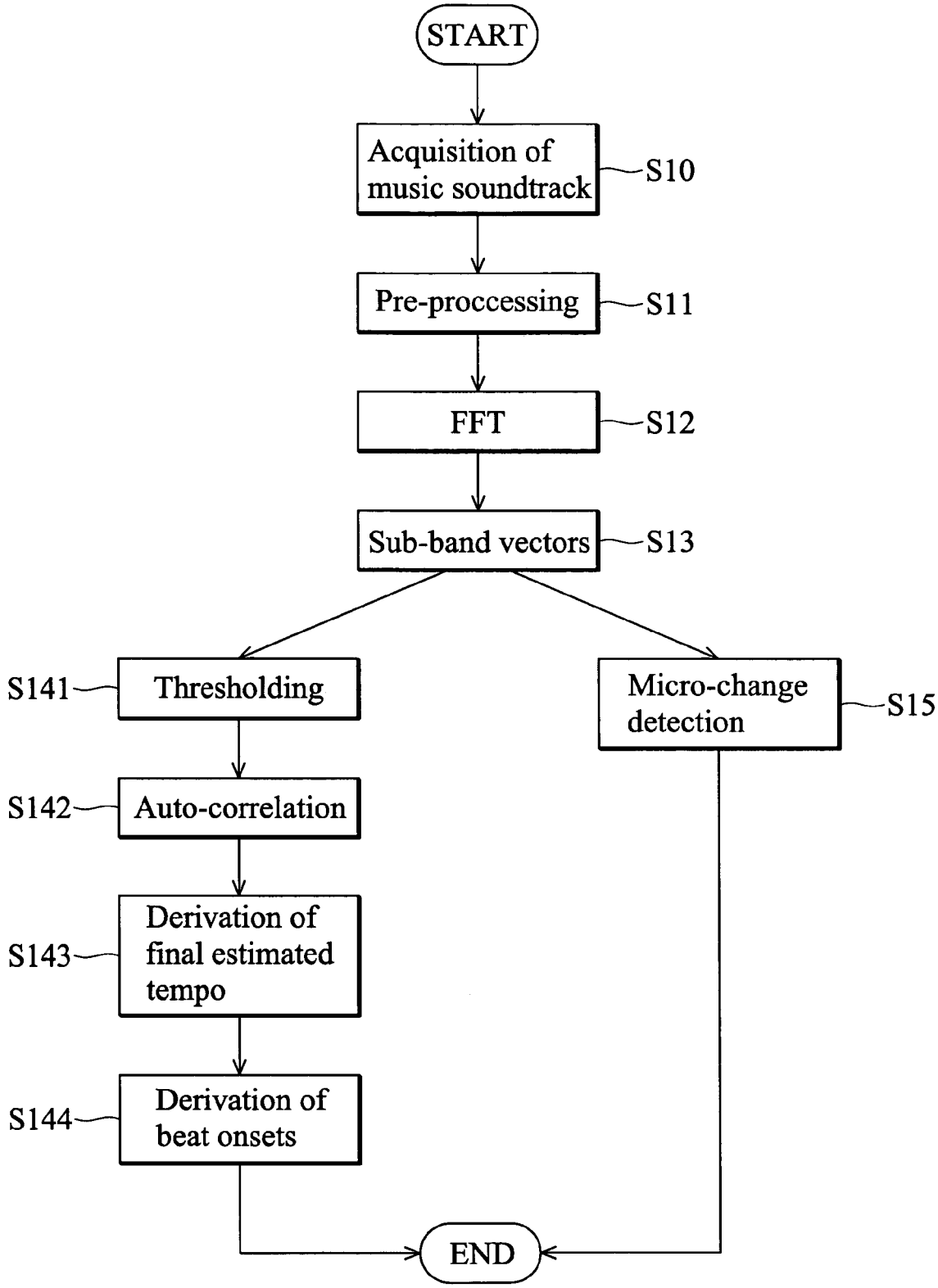
FIG. 1 is a flowchart of a method for tempo estimation, beat detection and micro-change detection according to one embodiment of the invention.

FIG. 1 is a flowchart of a method for tempo estimation, beat detection and micro-change detection according to one embodiment of the invention.

In step S10, a music soundtrack is acquired. For example, the tempo of the music soundtrack ranges from 60 to 180 M.M. (beats per minute).

Figure 2:
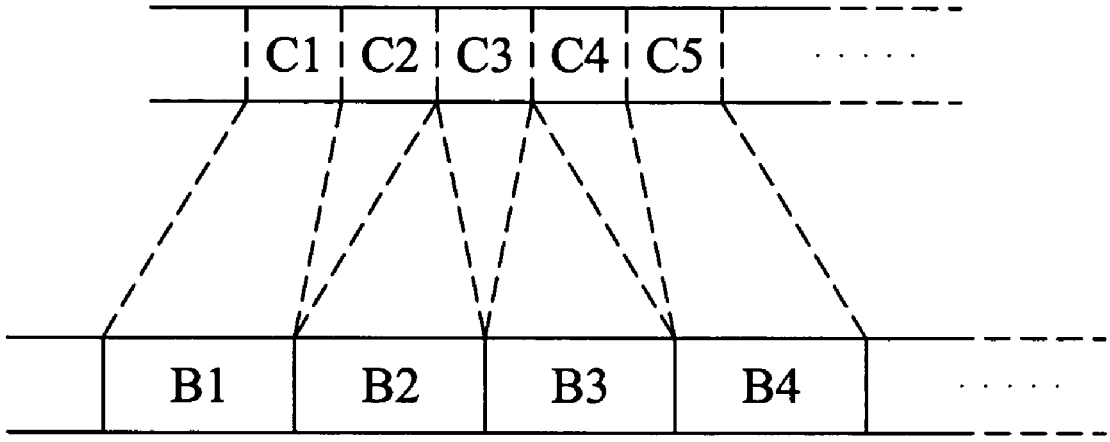
FIG. 2 shows the audio blocks according to one embodiment of the invention.

In step S11, the audio stream of the music soundtrack is preprocessed. The audio stream is re-sampled. As shown in FIG. 2, the original audio stream is divided into chunks C1, C2, . . . , each including, for example, 256 samples. The block B1 is composed of the chunks C1 and C2, the block B2 is composed of the chunks C2 and C3, and so forth. Thus, the blocks B1, B2, . . . have samples overlapping with each other.

In step S12, FFT is applied to each audio block, which converts the audio blocks from time domain to frequency domain.

In step S13, a pair of sub-band vectors are derived from each audio block, wherein one vector is for tempo estimation and beat detection while the other is for micro-change detection. The components of each vector are energy summations of the audio block within different frequency ranges (sub-bands) and the sub-band sets for the two vectors are different. The vectors may be represented by:

$$V1_{(n)}=(A_1(n),A_2(n), \ldots ,A_1(n)) \text{ and}$$

$$V2_{(n)}=(B_1(n), B_2(n), \ldots , B_J(n)),$$

where $V1_{(n)}$ and $V2_{(n)}$ are the two vectors derived from the $n^{th}$ audio block, $A_i(n)$ (i=1~I) is the energy summation of the $n^{th}$ audio block within the $i^{th}$ sub-band of the sub-band set for tempo estimation and beat detection, and $B_j(n)$ (j=1~J) is the energy summation of the $n^{th}$ audio block within the $j^{th}$ sub-band of the sub-band set for micro-change detection. Further, the energy summations are derived from the following equations:

$$A_i(n) = \sqrt{\sum_{k=L_i}^{H_i} a(n, k)} \text{ and}$$

$$B_j(n) = \sqrt{\sum_{k=L_j}^{H_i} a(n, k)},$$

where $L_i$ and $H_i$ are the lower and upper bounds of the $i^{th}$ sub-band of the sub-band set for tempo estimation and beat detection, $L_j$ and $H_j$ are the lower and upper bounds of the $j^{th}$ sub-band of the sub-band set for micro-change detection, and a(n,k) is the energy value (amplitude) of the $n^{th}$ audio block at frequency k. For example, the sub-band set for tempo estimation and beat detection comprises three sub-bands [0 Hz, 125 Hz], [125 Hz, 250 Hz] and [250 Hz, 500 Hz] while that for micro-change detection comprises four sub-bands [0 Hz, 1100 Hz], [1100 Hz, 2500 Hz], [2500 Hz, 5500 Hz] and [5500 Hz, 11000 Hz]. Since drum sounds with low frequencies are so regular in most pop music that beat onsets can be easily derived from them, the total range of the sub-band set for tempo estimation and beat detection is lower than that for micro-change detection.

In step S141, each sequence composed of the components in the same sub-band of the vectors $\mathbf{V1}_{(1)}, \mathbf{V1}_{(2)}, \ldots, \mathbf{V1}_{(N)}$ (N is the number of the audio blocks) is filtered to eliminate noise. For example, there are three sequences respectively for the sub-bands [0 Hz, 125 Hz], [125 Hz, 250 Hz] and [250 Hz, 500 Hz]. In each sequence, only the components having amplitudes larger than a predetermined value are left unchanged while the others are set to zero.

In step S142, auto-correlation is applied to each of the filtered sequences. In each filtered sequence, correlation results are calculated using tempo values, for example, from 60 to 186 M.M., wherein the tempo value generating the largest correlation results is the estimated tempo and a confidence value of the estimated tempo is the largest correlation results. Additionally, a threshold for determination of validity of the correlation results may be used, wherein only the correlation results larger than the threshold is valid. If there is no valid correlation results in one of the sub-bands, the estimated tempo and confidence value of that sub-band are set to 60 and 0 respectively.

In step S143, by comparing the confidence values of the estimated tempo of all the sub-bands for tempo estimation and beat detection, the estimated tempo with the largest confidence value is determined as the final estimated tempo.

In step S144, the beat onsets are determined by the final estimated tempo. First, the maximum peak in the sequence of the sub-band whose estimated tempo is the final estimated tempo is identified. Second, the neighbors of the maximum peak within a range of the final estimated tempo is deleted. Third, the next maximum peak in the sequence is identified. Fourth, the second and third steps are repeated until no more peak is identified. These identified peaks are beat onsets.

In step 15, micro-changes in the music soundtrack is detected using the sub-band vectors $\mathbf{V2}_{(1)}, \mathbf{V2}_{(2)}, \ldots, \mathbf{V2}_{(N)}$. A micro-change value MV is calculated for each audio block. The micro-change value is the sum of differences between the current vector and previous vectors. More specifically, the micro-change value of the nth audio block is derived by the following equation:

$$MV_{(n)}=\mathrm{Sum}(\mathrm{Diff}(V2_{(n)}, V2_{(n-1)}),\mathrm{Diff}(V2_{(n)}, V2_{(n-2)}), \mathrm{Diff}(V2_{(n)},V2_{(n-3)}),\mathrm{Diff}(V2_{(n)},V2_{(n-4)}))$$

The difference between two vectors may be defined variously. For example, it may be the difference between the amplitudes of the two vectors. After the micro-change values are derived, they are compared to a predetermined threshold. The audio blocks having micro-change values larger than the threshold are identified as micro-changes.

In the previously described embodiment, the sub-band sets may be determined by user input, which achieves an interactive music analysis.

In conclusion, the present invention provides a method for tempo estimation, beat detection and micro-change detection for music, which yields indices for alignment of soundtracks with video clips. The tempo value, beat onsets and micro-changes are detected using sub-band vectors of audio blocks having overlapping samples. The sub-band sets defining the vectors may be determined by user input. Thus, the indices for alignment of soundtracks with video clips are more accurate and easily derived.

The foregoing description of the preferred embodiments of this invention has been presented for purposes of illustration and description. Obvious modifications or variations are possible in light of the above teaching. The embodiments were chosen and described to provide the best illustration of the principles of this invention and its practical application to thereby enable those skilled in the art to utilize the invention in various embodiments and with various modifications as are suited to the particular use contemplated. All such modifications and variations are within the scope of the present invention as determined by the appended claims when interpreted in accordance with the breadth to which they are fairly, legally, and equitably entitled.

What is claimed is:

1. A method for music analysis comprising the steps of:

acquiring a music soundtrack;

re-sampling an audio stream of the music soundtrack so that the re-sampled audio stream is composed of blocks;

applying Fourier Transformation to each of the blocks;

deriving a first vector from each of the transformed blocks, wherein components of the first vector are energy summations of the block within a plurality of first sub-bands;

applying auto-correlation to each sequence composed of the components of the first vectors of all the blocks in the same first sub-band using a plurality of tempo values, wherein, for each sequence, a largest correlation result is identified as a confidence value and the tempo value generating the largest correlation result is identified as an estimated tempo;

comparing the confidence values of all the sequences to identify the estimated tempo corresponding to the largest confidence value as a final estimated tempo; and aligning the soundtrack with image transition using indices yielded from music analysis based on the final estimated tempo.

2. The method as claimed in claim 1 further comprising the step of:

deriving a second vector from each of the transformed blocks, wherein components of the second vector are energy summations of the block within a plurality of second sub-bands; and detecting micro-changes using the second vectors.

3. The method as claimed in claim, wherein, for each block, a micro-change value which is a sum of differences between the second vectors of the block and previous blocks is calculated.

4. The method as claimed in claim 3, wherein each micro-change value is derived by the following equation:

$$MV_{(n)}=\mathrm{Sum}(\mathrm{Diff}(V2_{(n)}, V2_{(n-1)}),\mathrm{Diff}(V2_{(n)}, V2_{(n-2)}),\mathrm{Diff}(V2_{(n)}, V2_{(n-3)}),\mathrm{Diff}(V2_{(n)}, V2_{(n-4)})),$$

where MV(n) is the micro-change value of the nth block, V2(n) is the second vector of the nth block, V2(n-1) is the second vector of the (n-1)th block, V2(n-2) is the second vector of the (n-2)th block, V2(n-3) is the second vector of the (n-3)th block and V2(n-4) is the second vector of the (n-4)th block.

5. The method as claimed in claim 4, wherein the difference between two of the second vectors is a difference of amplitudes thereof.

6. The method as claimed in claim 5, wherein the micro-change values are compared to a predetermined threshold, and the blocks having the micro-change values larger than the threshold are identified as micro-changes.

7. The method as claimed in claim 6, wherein the second sub-bands are [0 Hz, 1100 Hz], [1100 Hz, 2500 Hz], [2500 Hz 5500 Hz] and [5500 Hz, 11000 Hz].

8. The method as claimed in claim 6, wherein the second sub-bands are determined by user input.

9. The method as claimed in claim 1 further comprising the step of filtering the sequences before application of auto-correlation, wherein only the components having amplitudes larger than a predetermined value are left unchanged while the others are set to zero.

10. The method as claimed in claim 1, wherein the audio stream is re-sampled by the steps of dividing the audio stream into chunks and joining two adjacent chunks into one block so that the blocks have samples overlapping with each other.

11. The method as claimed in claim 10, wherein the number of the samples in one chunk is 256.

12. The method as claimed in claim 1, wherein the energy summation of the nth block within the ith sub-band is derived from the following equation:

$$A_i(n) = \sqrt{\sum_{k=L_i}^{H_i} a(n, k)},$$

where Li and Hi are lower and upper bounds of the ith sub-band, and a(n,k) is an energy value (amplitude) of the nth block at a frequency k.

13. The method as claimed in claim 1, wherein the first sub-bands are [0 Hz, 125 Hz], [125 Hz] and [250 Hz, 500 Hz].

14. The method as claimed in claim 1, wherein the first sub-bands are determined by user input.

15. The method as claimed in claim 1 further comprising the step of determining beat onsets of the music soundtrack using the final estimated tempo.

16. The method as claimed in claim 15, wherein the beat onsets are determined by the steps of:

a) identifying a maximum peak in the sequence of the sub-band whose estimated tempo is the final estimated tempo;

b) deleting neighbors of the maximum peak within a range of the final estimated tempo;

c) identifying a next maximum peak in the sequence; and d) repeating the steps b) and c) until no more peak is identified;

wherein all the identified peaks are the beat onsets.

* * * * *